US009737121B2

(12) United States Patent
Chen et al.

(10) Patent No.: US 9,737,121 B2
(45) Date of Patent: Aug. 22, 2017

(54) ADAPTIVE PIVOTING AND IMPACT REDUCTION TIP ASSEMBLY FOR WALKING AIDS

(71) Applicants: Shyh Min Chen, Plano, TX (US); James Dale Jordan, Grapevine, TX (US); Dale Bourland Jordan, Birmingham, AL (US)

(72) Inventors: Shyh Min Chen, Plano, TX (US); James Dale Jordan, Grapevine, TX (US); Dale Bourland Jordan, Birmingham, AL (US)

(73) Assignee: 3C AUTOMATION, INC., Plano, TX (US)

( * ) Notice: Subject to any disclaimer, the term of this patent is extended or adjusted under 35 U.S.C. 154(b) by 0 days.

(21) Appl. No.: 15/368,333

(22) Filed: Dec. 2, 2016

(65) Prior Publication Data

US 2017/0156459 A1 Jun. 8, 2017

Related U.S. Application Data

(60) Provisional application No. 62/262,727, filed on Dec. 3, 2015.

(51) Int. Cl.
*A45B 9/04* (2006.01)
*A61H 3/02* (2006.01)

(52) U.S. Cl.
CPC ..... *A45B 9/04* (2013.01); *A61H 3/0277* (2013.01); *A61H 3/0288* (2013.01)

(58) Field of Classification Search
CPC ..... A45B 9/04; A61H 3/0288; A61H 3/02; A61H 3/0277
USPC ..... 135/65, 66, 77, 82, 84; 248/188.9
See application file for complete search history.

(56) References Cited

U.S. PATENT DOCUMENTS

| | | | | |
|---|---|---|---|---|
| 679,468 | A * | 7/1901 | Pratt | A61H 3/0288 114/79 R |
| 2,397,499 | A * | 4/1946 | McGowan | A61H 3/0277 135/66 |
| 2,513,193 | A * | 6/1950 | Miller | A47B 91/04 16/38 |
| 3,949,773 | A | 4/1976 | Marescalco | |
| 4,135,536 | A | 1/1979 | Willis | |
| 5,307,828 | A | 5/1994 | Gardner et al. | |
| 5,727,584 | A | 3/1998 | Stanec | |
| 5,810,038 | A | 9/1998 | Carpinella | |
| 5,865,204 | A | 2/1999 | Bracy | |
| 6,279,592 | B1 | 8/2001 | Yamamoto | |
| 6,374,841 | B1 | 4/2002 | Yamamoto et al. | |
| 6,883,530 | B2 * | 4/2005 | Kawakami | A45B 9/04 135/82 |

(Continued)

FOREIGN PATENT DOCUMENTS

| | | |
|---|---|---|
| EP | 0 057 269 A2 | 10/1981 |
| GB | 2 333 446 A | 7/1999 |

(Continued)

*Primary Examiner* — Winnie Yip
(74) *Attorney, Agent, or Firm* — Kenneth L. Green; Averill & Green

(57) ABSTRACT

An adaptive ambulatory support includes a shock absorbing and pivoting tip assembly attached to the staff of a walking aid, such as a cane, crutch or walker. The shock absorbing and pivoting tip assembly includes a shock absorber sandwiched between a lower portion and an upper portion. The shock absorber may be a bendable spring or elastic material. The tip assembly enables the shaft of the walking aid to dynamically pivot without the loss of adherence of the lower portion to the floor surface and simultaneous provides the adaptive shock absorbing capability in any angle during ambulation.

18 Claims, 7 Drawing Sheets

(56) References Cited

U.S. PATENT DOCUMENTS

| | | | | |
|---|---|---|---|---|
| 6,910,246 | B2 * | 6/2005 | Desmarais | A47B 91/066 16/42 R |
| 7,588,044 | B2 * | 9/2009 | Baker | A61H 3/02 135/82 |
| D635,351 | S | 4/2011 | White | |
| 8,596,288 | B2 * | 12/2013 | Daily | A45B 7/00 135/65 |
| 8,820,339 | B2 * | 9/2014 | Goodwin | A45B 9/04 135/82 |
| 9,226,556 | B1 * | 1/2016 | Chien | A61H 3/0288 |
| 9,386,830 | B2 * | 7/2016 | Crowhurst | A45B 9/00 |
| 2004/0107983 | A1 | 6/2004 | Liao | |
| 2007/0089770 | A1 * | 4/2007 | Park | A61H 3/0277 135/82 |
| 2009/0242008 | A1 | 10/2009 | Thibodeau et al. | |
| 2010/0229903 | A1 | 9/2010 | Ozuna | |
| 2010/0307549 | A1 | 12/2010 | Goodwin | |
| 2011/0073146 | A1 | 3/2011 | Miller | |
| 2012/0160286 | A1 | 6/2012 | Ban | |
| 2013/0263903 | A1 | 10/2013 | Basham | |
| 2014/0041700 | A1 | 2/2014 | Wu | |
| 2014/0290709 | A1 | 10/2014 | Basham | |

FOREIGN PATENT DOCUMENTS

| | | | | |
|---|---|---|---|---|
| GB | 2 375 292 | A | | 11/2002 |
| GB | 2494906 | A | | 3/2013 |
| JP | 2015089464 | A | * | 5/2015 |

* cited by examiner

ADAPTIVE PIVOTING AND IMPACT REDUCTION TIP ASSEMBLY FOR WALKING AIDS

CROSS-REFERENCE TO RELATED APPLICATIONS

The present application claims the priority of U.S. Provisional Patent Application Ser. No. 62/262,727 filed Dec. 3, 2015, which application is incorporated in its entirety herein by reference.

BACKGROUND OF THE INVENTION

The present invention relates to walking aids and in particular to a walking cane having a shock absorbing tip.

Walking aids such as walking sticks, crutches and walkers are well known and have been available in many varieties to accommodate a person's need of support and ambulation. Also there are a variety of modifications and accessories to these aids to ergonomically improve the comfort and safety.

Most walking aids are provided with a rubber tip in an effort to provide stable engagement between the walking aids and the floor or other underlying support surface. In practice, however, it has been found that conventional rubber tips possess limitations which often result in severe injury to the user. For example, with most rubber tips the shaft of the walking aids needs to be held in substantially vertical alignment, so that the contact on the bottom of the tip is able to flatly engage the floor surface. Unfortunately, people frequently hold a walking aids at an outward angle from their bodies in an effort to steady themselves, so that the shaft extends at an angle to the floor rather than straight up and down. This causes the rubber tip to contact the floor at an angle, with only an edge of the tip engaging the floor surface. Consequently, when the person's weight bears on the cane at this angle, the tip tends to slide out, often causing the person to fall. Naturally, this problem is even more acute if the floor surface is slick or damp.

There are also numerous shock absorbing accessories added to the walking aids. However, these shock absorbing devices are intended to merely vertically absorb the impact of the cane or other walking aids on the floor surface or other underlying support surface.

While these walking aids fulfill their respective, particular objectives and requirements. They do not disclose an accessory for a walking aids which provides shockingly absorbing to reduce the impact as well as pivoting where the foot or tip of the accessory is maintained in a planar relationship with the supporting floor surface. In this regard where the foot or tip of the free end of the walking aid can be maintained in a parallel planar relationship with the floor supporting surface, no matter at what angle the walking aid is inclined relative to the supporting surface.

BRIEF SUMMARY OF THE INVENTION

The present invention addresses the above and other needs by providing an adaptive ambulatory support includes a shock absorbing and pivoting tip assembly attached to the staff of a walking aid, such as a cane, crutch or walker. The shock absorbing and pivoting tip assembly includes a shock absorber sandwiched between a lower portion and an upper portion. The shock absorber may be a bendable spring or elastic material. The tip assembly enables the shaft of the walking aids to dynamically pivot without the loss of adherence of the lower portion to the floor surface and simultaneous provides the adaptive shock absorbing capability in any angle during ambulation.

In accordance with one aspect of the invention, there is provided an accessory for walking aids which provides shocking absorbing and reduced impact as well as pivoting where the foot or tip of the accessory is maintained in a planar relationship with the supporting ground surface. In this regard where the foot or tip of the free end of the walking aid can be maintained in a parallel planar relationship with the ground supporting surface, no matter at what angle the walking aid is inclined relative to the supporting surface.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1B:
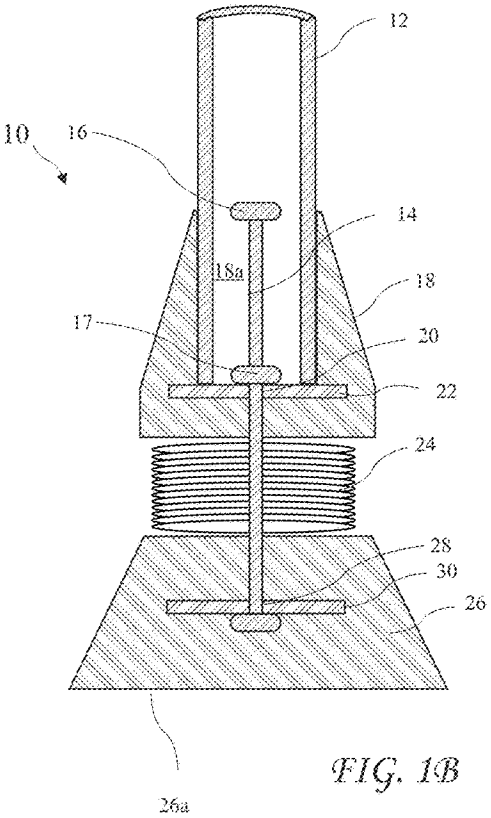
FIG. 1B is a cross-sectional view of the cushioned walking stick tip according to the present invention taken along line 1B-1B of FIG. 1A.
Figure 1A:
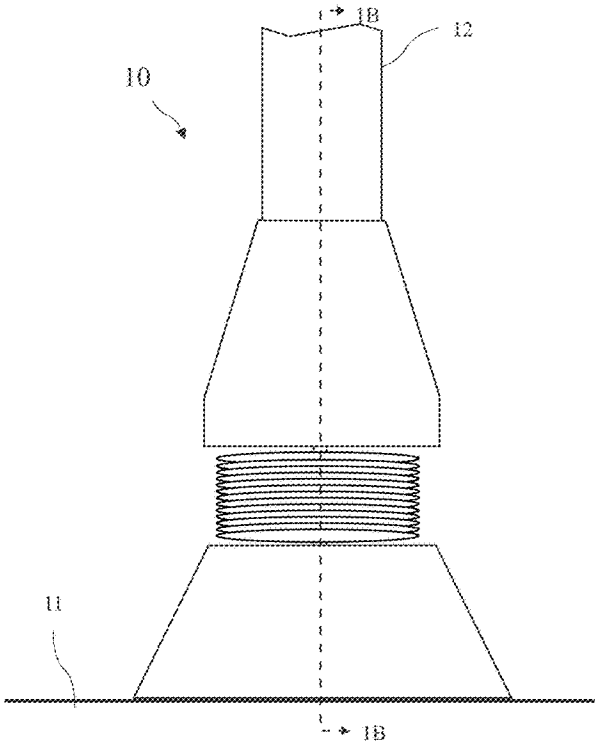
FIG. 1A is a side view of a cushioned walking stick tip according to the present invention.

A side view of a cushioned walking stick tip 10 according to the present invention is shown residing on a generally horizontal surface 11 in FIG. 1A and a cross-sectional view of the cushioned walking stick tip 10 along line 1B-1B of FIG. 1A is shown in FIG. 1B. The cushioned walking stick tip 10 is an economical direct replacement for the simple rubber tip commonly used in walking aids, providing an easy and economical solution to ambulatory support and traction for a walking aid such as a cane, crutches and walkers. The cushioned walking stick tip 10 includes four major components, an upper portion 18 including a shaft passage 18*a* receiving a shaft 12 of the walking aid, a lower portion 26 having a bottom surface 26*a* which maintains a parallel planar relationship with the ground, a shock absorbing element 24 between the upper portion 18 and the lower portion 26, and a pivoting connecting rod 14 embedded in the lower portion 26 and connecting the upper portion 18 to the lower portion 26. The upper portion 18 is preferably connectable to the shaft 12 without tools or an adaptor.

The tip assembly 10 provides an upper pivot 20 in the upper portion 18 and a lower pivot 28 in the lower portion 26. The attitude of the lower pivot 28 is generally fixed with respect to the generally horizontal surface 11 and is limited to movement resulting from deformation of the lower portion 26. The lower pivot 28 allows the angulation of the connecting rod 14 when a rod top stop 16 reaches the inner wall of the shaft 12. The force from the partial body weight and the angulation is passed from the shaft 12 to the rod top stop 16. The force applied to the rod top stop 16 causes the connecting rod 14 to pivot around the lower pivot 28.

The upper portion 18 and upper pivot 20 may both pivot and depress vertically under a load. The position of the upper pivot 20 is the location where the partial body weight bears on the shaft 12 and the compression force of the shock absorber 24 reach a balance. The partial body weight on the shaft 12 is different for each ambulation because of angulation, therefore the tip assembly 10 adaptively seeks the dynamically moving pivot until the balance of the forces is reached. The upper pivot 20 allows the angulation of the shaft 12 relative to both the upper portion 18 and the lower portion 26.

The location of the upper pivot 20 is established by an upper centering piece 22 fixed to the upper portion 18 and the lower pivot 28 may be established by a lower centering piece 30 fixed to the lower portion 26. The upper and lower centering pieces 22 and 30 are preferably disks embedded in the upper portion 18 and lower portion 26 respectively. The connecting rod 14 includes a rod top stop 16 at the top of the connecting rod 14 limiting pivoting about the upper pivot 20 by the connecting rod 14 by contact of the rod top stop 16 with the interior of the shaft 12, and a rod center stop 17 retaining the upper portion 18 on the connecting rod 14.

An upper pivot point 20 allows pivotal motion of the upper portion 18 of the walking aid 10 relative to the connecting rod 14 and the lower portion 26 while the rod top stop 16 is not touching the inner wall of the shaft 12. The connecting rod 14 is generally perpendicular to the lower portion 26 and the surface 11 when relaxed. The lower pivot 28 also allows the angulation of the upper portion 18 and the shaft 12 relative to the lower portion 26 and the surface 11 when the rod top stop 16 touches the inner wall of the shaft 12. Sufficient force on rod top stop 16 due the angulation of the shaft 12 may cause the connecting rod to 14 pivot at the lower pivot point 28.

Figure 2:
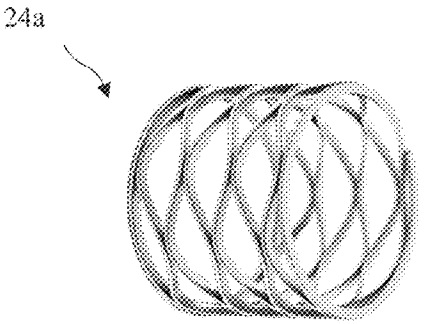
FIG. 2 shows a shock absorber according to the present invention.

The shock absorbing element 24 resides between the upper portion 18 and the lower portion 26 and is retained in place by the connecting rod 14. The shock absorbing element 24 may be a metal spring, elastic material, or any structure which is both compressible and flexible. An example of a suitable shock absorber 24 is a wave spring 24*a* shown in FIG. 2. The spring 24*a* is interchangeable to allow the user to select a different spring 24*a* with different spring constant to provide a desired stability or comfort level.

Figure 3C:
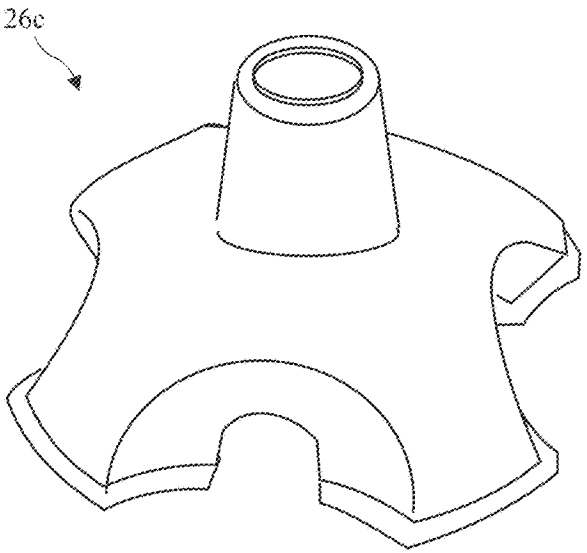
FIG. 3C shows a quadruple contact tip according to the present invention.
Figure 3B:
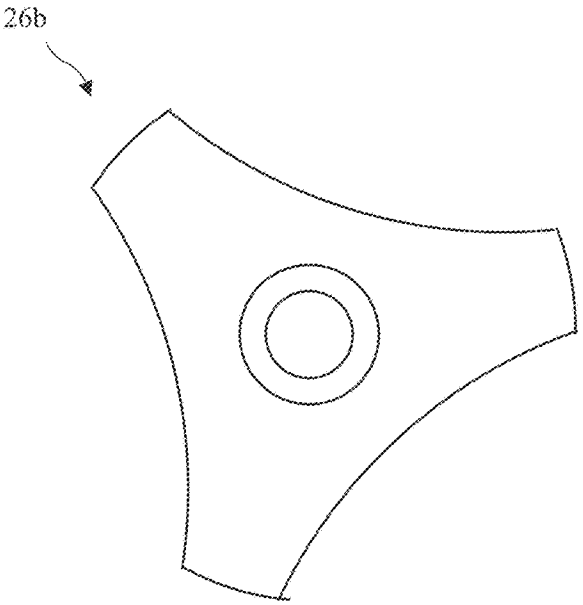
FIG. 3B shows a triple contact tip according to the present invention.
Figure 3A:
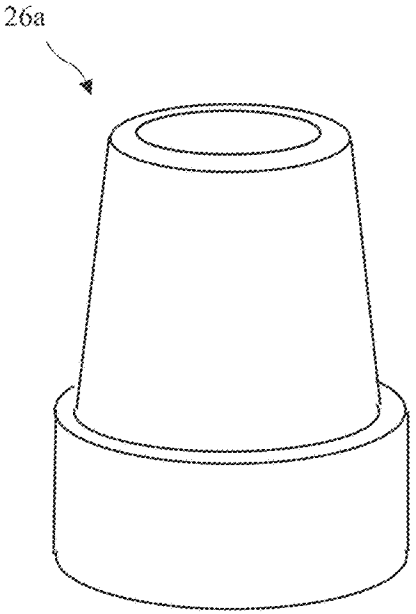
FIG. 3A shows a single contact tip according to the present invention.

The lower portion 26 preferably maintains in a parallel planar relationship with the surface 11. FIGS. 3A, 3B and 3C show examples of single contact 26*a* or multiple contact such three toe tri-pod 26*b* or four toe quad-pod contact 26*c*. The multiple prong lower tips 26*b* and 26*c* enable the support to be self-standing.

The connecting rod 14 is ridged and resides substantially perpendicular to the lower portion 26 and surface 11 for small angular deflections of the shaft 12, and supports dynamic pivoting of the upper portion 18 about the lower pivot 28. The connecting rod 14 is also a mechanical guide which guides the upper portion 18 to move up and down along the connecting rod 14 during ambulation. The connecting rod 14 is a safety device to prevent the upper portion 18 and shaft 12 from over tilting, causing contact of the rod top stop 16 with the shaft 12, which may cause a user to fall.

Figure 4A:
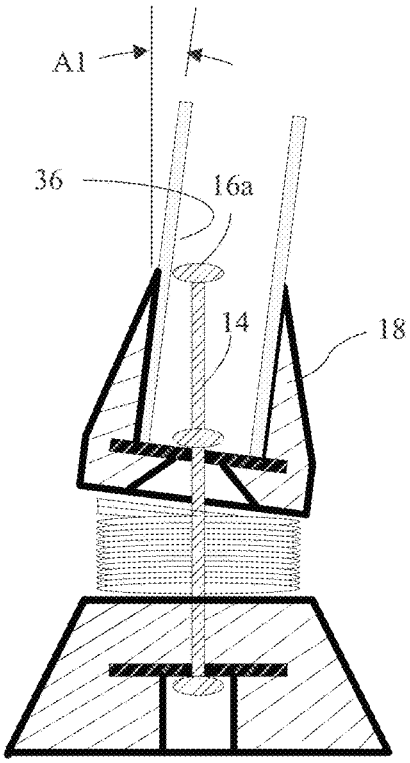
FIGS. 4A and 4B compare angulation of the tip using larger and smaller rod top stops according to the present invention.

FIG. 4A shows the connecting rod 14 with a larger rod top stop 16*a*. The larger rod top stop 16*a* functions as mechanical stop that resists the upper portion 18 and shaft 12 from further tilting thus limits the angle of angulation during ambulation to a first angle A1.

Figure 4B:
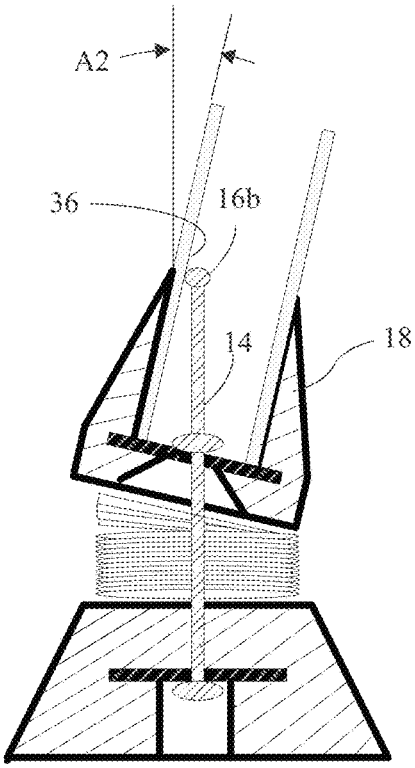

FIG. 4B shows the connecting rod 14 with a smaller rod top stop 16*b*. The rod top stop 16*b* creates clearance to allow the upper portion 16 and the shaft 12 to tilt further to an angle A2 compared to the rod with the larger end stop 16*a*. The end stops 16*a* and 16*b* are preferably interchangeable to allow the user to use different sizes of end stop which fits them better to provide better stability and comfort.

Figure 5A:
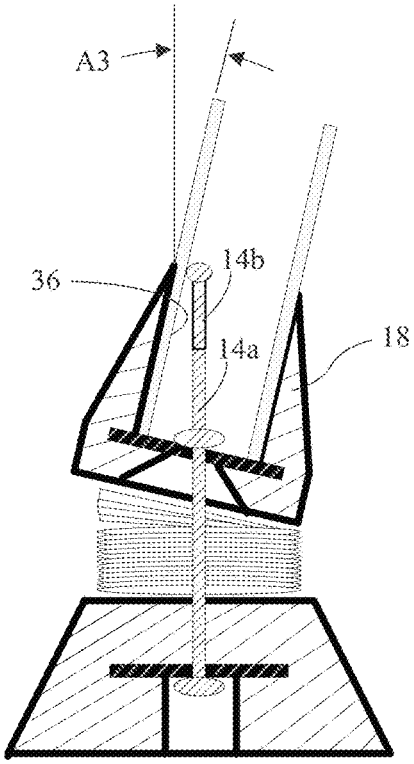
FIGS. 5A and 5B compare angulation of the tip using longer and short connecting rods according to the present invention.
Figure 5B:
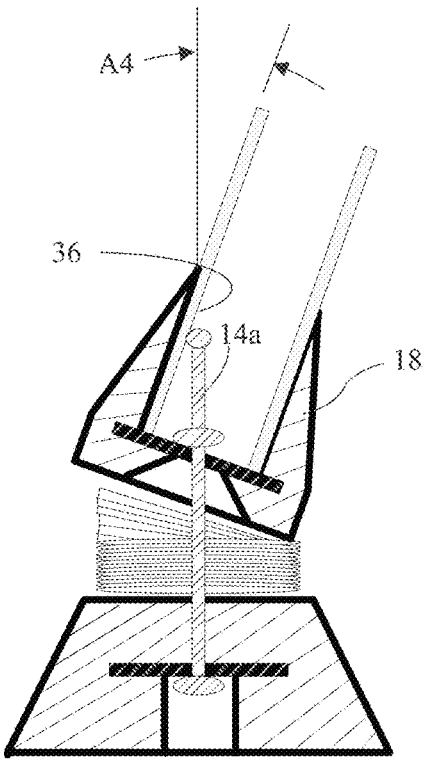

FIGS. 5A and 5B show a connecting rod 14 having an adjustable length. The length of the connecting rod 14 inside the shaft 12 can be extended by attaching a removable rod section 14*b* to a base rod 14*a*. The length can be reduced by detaching the removable rod 14*b*. By adjusting the length of the connecting rod 14 the maximum of angle of upper portion 18 with respect to the connecting rod 14 can be adjusted. A smaller angle A3 is shown in FIG. 5A when the removable rod section 14*b* is attached to the base rod 14*a*, and a greater angle A4 is shown in FIG. 5B when the removable rod section 14*b* is not attached to the base rod 14*a*

Figure 6A:
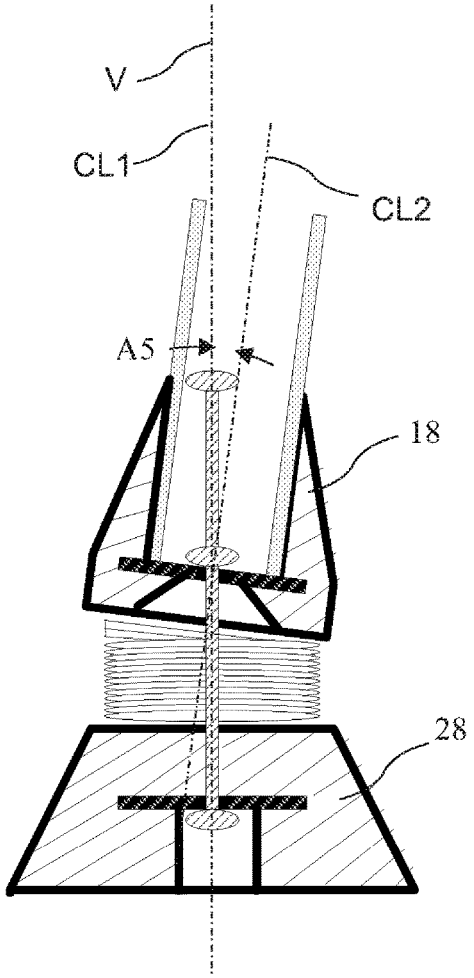
FIGS. 6A and 6B compare angulation of the upper portion of the tip when the connecting rod is vertical and when the connecting rod is tilted, according to the present invention.

FIG. 6A shows a tilt angle A5 between a centerline CL1 of the connecting rod 14 (aligned with vertical V) and a centerline CL2 of the upper portion 18 when the rod top stop 16 reaches the inner wall of shaft 12 during the ambulation of the user. The connecting rod 14 maintains a substantially vertical position and the lower portion 26 maintains a planar relationship to the surface 11 to maintain the stability and safety.

Figure 6B:
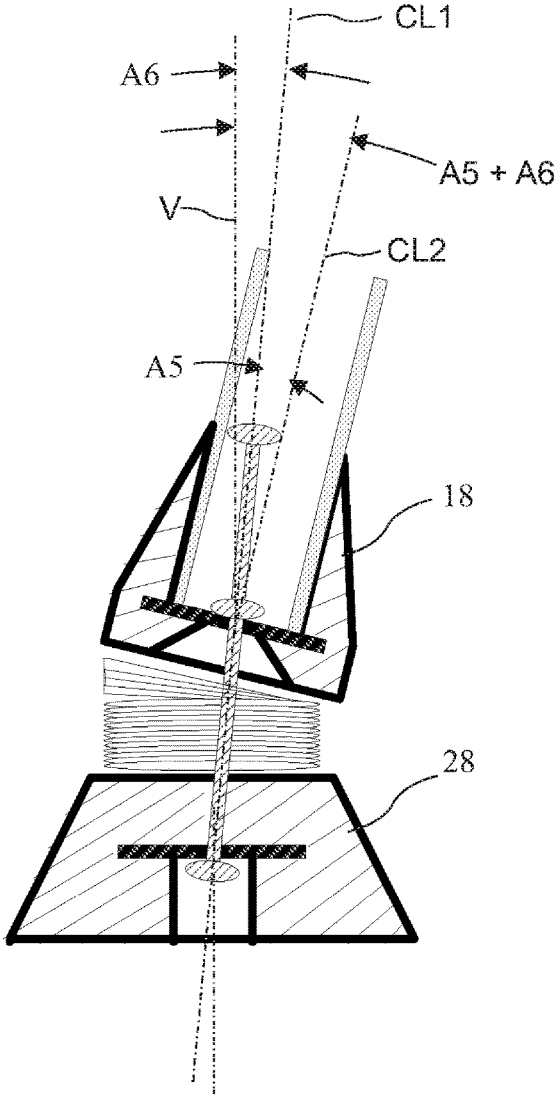

FIG. 6B shows the tilting A5 of the centerline CL2 of upper portion 18 with respect to the connecting rod 14, as well as the tilting A6 of the centerline CL1 of the connecting rod 14 with respect to the vertical V, when force from the inner wall of the shaft 12 is applied against the rod top stop 14. The connecting rod 14 moves away from the vertical V position but the lower portion 26 maintains a planar relationship to the surface 11 to maintain the stability and safety.

The tilting angle of the centerline CL1 of the connecting rod 14 with respect to the vertical V is an angle A6. The total angle of angulation of the upper portion 18 is angle A5 plus A6.

Figures 7A, 7B, 7C:
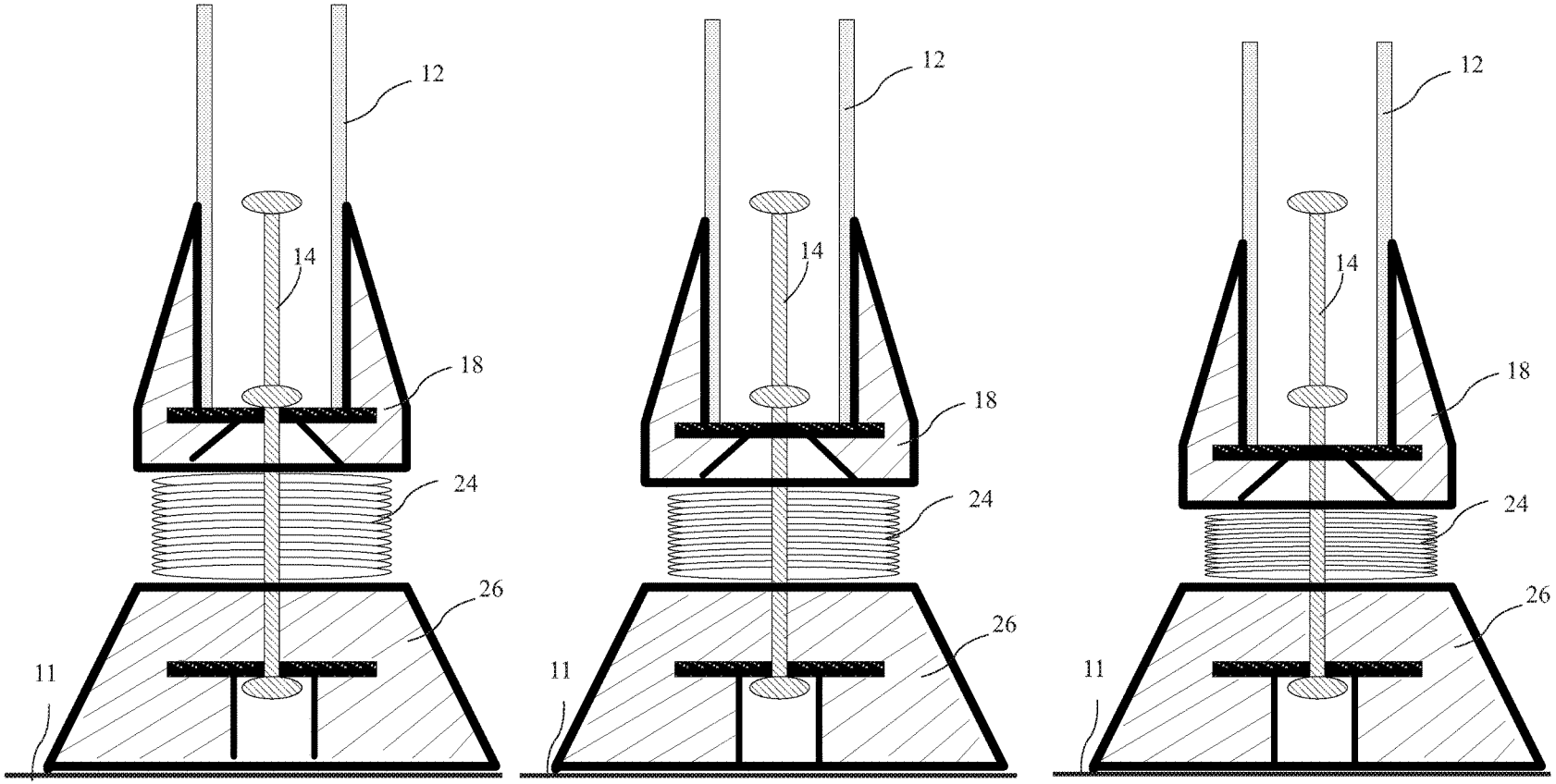
FIGS. 7A, 7B and 7C compare a vertical position of the upper portion for different amounts for vertical force on the tip, according to the present invention.

FIGS. 7A, 7B and 7C depict a shock absorbing capability when only a vertical force is applied downward on the cushioned walking stick tip 10. The upper portion 18 moves downward along the connecting rod 14. The distance the upper portion 18 travels downward depends on the downward force and the resistance of the shock absorber 24. The lower portion 26 maintains planar relationship with the surface 11.

Figure 8C:
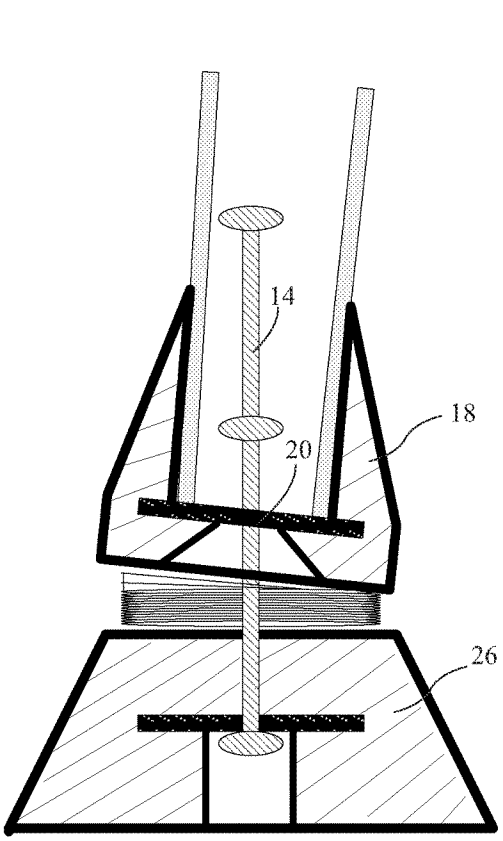
FIGS. 8A, 8B and 8C compare a vertical position of the upper portion for different amounts for vertical force on the tip when the upper portion is tilted, according to the present invention.
Figure 8B:
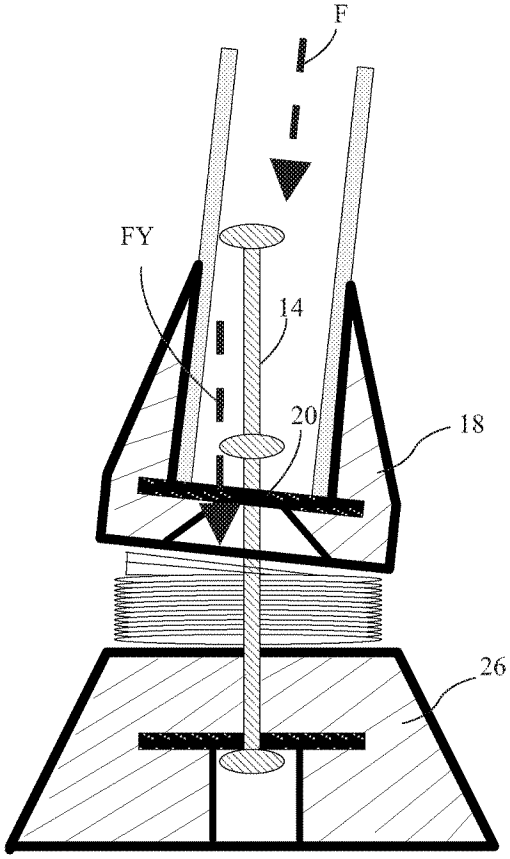
Figure 8A:
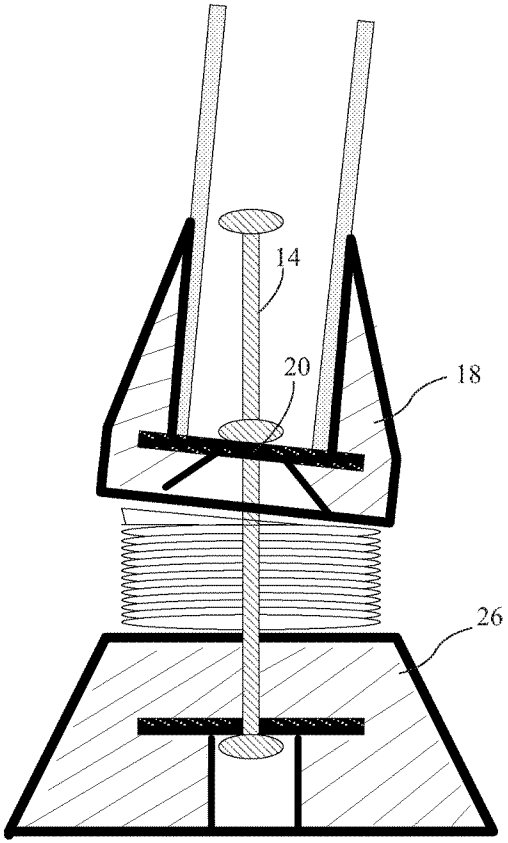

FIGS. 8A, 8B and 8C depict the upper pivot 20 moving progressively along the connecting rod 14 during the ambulation. The upper portion 18 is tilted at a fixed angulation in FIGS. 8A, 8B and 8C for illustration purpose. The actual tilting angle varies depending on the load from partial body weight on the walking aid. The distance the upper portion 18 travels downward depends on the vertical component FY of the force F the shaft 12 exerts on the upper portion 18, and the resistance of the shock absorber 24. The lower portion 26 maintains planar relationship with the surface 11.

Figure 9:
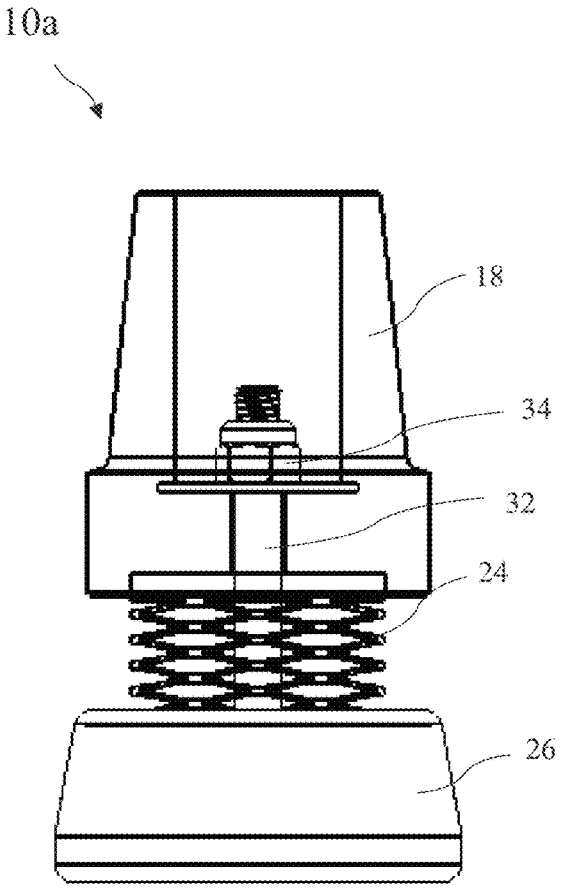
FIG. 9 shows a cushioned walking stick tip according to the present invention including a connecting bolt.
Figure 10:
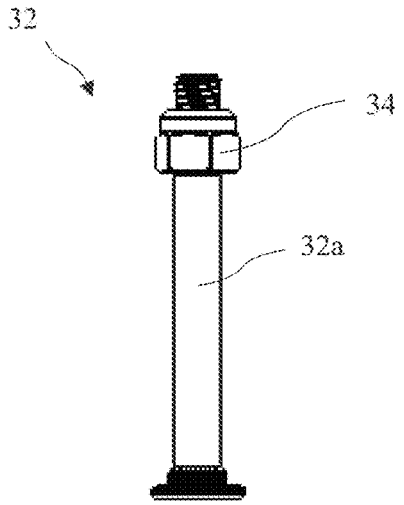
FIG. 10 shows the connecting bolt according to the present invention.

FIG. 9 shows a cushioned walking stick tip 10*a* including a connecting bolt 32 and FIG. 10 shows the connecting bolt 32 and nut 34. The connecting bolt 32 connects the upper portion 18 to the lower portion 26 sandwiching the shock absorber 24. The nut 34 may be a lock nut, or may be a nut tightened against an unthreaded portion 32*a* of the connecting bolt 32.

While the invention herein disclosed has been described by means of specific embodiments and applications thereof, numerous modifications and variations could be made thereto by those skilled in the art without departing from the scope of the invention set forth in the claims.

We claim:

1. A cushioned walking stick tip, comprising:

a lower portion having a bottom surface configured to rest against a horizontal surface;

an upper portion having a shaft passage configured to receive a user support shaft;

a shock absorber residing between the lower portion and the upper portion;

a connecting rod connecting the lower portion to the upper portion, a shaft configured for grasping by a user, the shaft attached to the shaft passage of the upper portion extending up from the upper portion, and the shaft and upper portion pivotable an upper angle together with respect to the connecting rod in a vertical position;

wherein the shock absorber is deformable to allow the connecting rod to pivot a lower angle with respect to the lower portion, resulting in the shaft and upper portion pivoting a total angle of the upper angle plus the lower angle with respect to the lower portion.

2. The tip of claim 1, wherein the connecting rod retains the shock absorber between the lower portion and the upper portion.

3. The tip of claim 2, wherein connecting rod passes through the shock absorber.

4. The tip of claim 3, wherein the connecting rod is rigid and cooperates with an upper pivot in the upper portion to allow the upper portion to pivot with respect to the connecting rod and the lower portion.

5. The tip of claim 4, wherein:

an upper centering piece is embedded into the upper portion; and the upper pivot is restrained by the upper centering piece to reside under a rod center stop to retain the upper portion on the connecting rod.

6. The tip of claim 5, wherein the shock absorber is compressible allowing the upper pivot and upper portion to slide towards the lower portion when downward force is applied to the upper portion through the shaft.

7. The tip of claim 5, wherein the connecting rod is embedded into the lower portion to resist pivoting of the connecting rod.

8. The tip of claim 1, wherein:

the shaft and upper portion pivot the upper angle together with respect to the connecting rod about an upper pivot; and the shock absorber is deformable to allow the connecting rod to pivot the lower angle with respect to the lower portion about a lower pivot, the lower pivot vertically spaced apart below the upper pivot.

9. The tip of claim 8, wherein:

the upper pivot resides in the upper portion; and the lower pivot reside in the lower portion.

10. The tip of claim 9, wherein:

the shaft and upper portion pivot with respect to the connecting rod, and the connecting rod remains vertical until a rod top stop of the connecting rod contacts the shaft; and after the rod top stop contacts the shaft, the connecting rod pivots away from the vertical about the lower pivot.

11. A cushioned walking stick tip, comprising:

a lower portion having a bottom surface configured to rest against a horizontal surface;

an upper portion having a shaft passage configured to receive a user support shaft, and an upper centering piece embedded into the upper portion to restrain an upper pivot thereon;

a shock absorber residing between the lower portion and the upper portion, the shock absorber compressible allowing the upper pivot and the upper portion to slide towards the lower portion when downward force is applied to the upper portion through the shaft; and a rigid connecting rod connecting the lower portion to the upper portion and cooperating with the upper pivot in the upper portion to allow the upper portion to pivot with respect to the connecting rod and the lower portion, and retaining the shock absorber between the lower portion and the upper portion, wherein an attitude of the connecting rod is biased by the lower portion to remain vertical with respect to the lower portion, but is pivotable if sufficient force is applied, and the shock absorber is deformable, to allow the connecting rod and upper portion to pivot at a lower pivot with respect to the lower portion.

12. The tip of claim 11, wherein:

the shaft and upper portion pivot an upper angle together with respect to the connecting rod about the upper pivot; and the shock absorber is deformable to allow the connecting rod to pivot a lower angle with respect to the lower portion about the lower pivot, the lower pivot vertically spaced apart below the upper pivot.

13. The tip of claim 12, wherein:

the upper pivot resides in the upper portion; and the lower pivot reside in the lower portion.

14. The tip of claim 13, wherein:

the shaft and upper portion pivot with respect to the connecting rod, and the connecting rod remains vertical until a rod top stop of the connecting rod contacts the shaft; and after the rod top stop contacts the shaft, the connecting rod pivots away from the vertical about the lower pivot.

15. A cushioned walking stick tip, comprising:

a lower portion having a bottom surface configured to rest against a horizontal surface;

an upper portion having a shaft passage configured to receive a user support shaft;

a shock absorber residing between the lower portion and the upper portion, the shock absorber compressible allowing the upper portion to slide towards the lower portion when downward force is applied to the upper portion by the shaft; and a rigid connecting rod connecting the lower portion to the upper portion and cooperating with an upper pivot in the upper portion to allow the upper portion to pivot with respect to the connecting rod and the lower portion, and passing through the shock absorber to retain the shock absorber between the lower portion and the upper portion, wherein:

an attitude of the connecting rod is biased by the lower portion to remain vertical with respect to the lower portion, but is pivotable if sufficient force is applied, and the shock absorber is deformable, to allow the connecting rod and upper portion to pivot at a lower pivot with respect to the lower portion; and the connecting rod has a rod top stop residing inside the user support shaft and limiting pivoting of the upper portion with respect to the connecting rod.

16. The tip of claim 15, wherein:

the shaft and upper portion pivot an upper angle together with respect to the connecting rod about the upper pivot; and the shock absorber is deformable to allow the connecting rod to pivot a lower angle with respect to the lower portion about the lower pivot, the lower pivot vertically spaced apart below the upper pivot.

17. The tip of claim 16, wherein:

the upper pivot resides in the upper portion; and the lower pivot reside in the lower portion.

18. The tip of claim 17, wherein:

the shaft and upper portion pivot with respect to the connecting rod and the connecting rod remains vertical until a rod top stop of the connecting rod contacts the shaft; and after the rod top stop contacts the shaft, the connecting rod pivots away from the vertical about the lower pivot.

* * * * *